United States Patent [19]

Gervasio

[11] Patent Number: 4,767,560

[45] Date of Patent: Aug. 30, 1988

[54] TOILET SOAP BARS MADE FROM TOPPED, DISTILLED COCO FATTY ACID AND PROCESSES FOR MANUFACTURE THEREOF

[75] Inventor: Gregorio C. Gervasio, Las Pinas Metro Manila, Philippines

[73] Assignee: Colgate-Palmolive Company, New York, N.Y.

[21] Appl. No.: 914,691

[22] Filed: Oct. 2, 1986

[51] Int. Cl.[4] ..... C11D 15/00

[52] U.S. Cl. ..... 252/108; 252/122; 252/126; 252/134; 252/367; 252/368; 252/369; 252/DIG. 16

[58] Field of Search ..... 252/108, 122, 126, 134, 252/174, DIG. 16, 367, 368, 369

[56] References Cited

U.S. PATENT DOCUMENTS

| | | | |
|---|---|---|---|
| 3,657,146 | 4/1972 | Fransen et al. | 252/108 |
| 4,308,157 | 12/1981 | Di Giovanna | 252/134 |
| 4,468,338 | 8/1984 | Lindberg | 252/DIG. 16 |

FOREIGN PATENT DOCUMENTS

| | | |
|---|---|---|
| 664484 | 1/1952 | United Kingdom . |
| 1059089 | 2/1967 | United Kingdom . |

*Primary Examiner*—A. Lionel Clingman

*Assistant Examiner*—Hoa Van Le

*Attorney, Agent, or Firm*—Murray M. Grill; Norman Blumenkopf

[57] ABSTRACT

Toilet soap bars, preferably milled and plodded, made from topped, distilled coco fatty acid, which is partially saponified, are superior to tallow-coco soaps and palm oil - palm kernel oil soaps in foaming properties and lather generation, especially in cold water, and are milder to the hands. Yet, such soaps, despite being made entirely from topped, distilled coco fatty acid, are desirably plastic, which improves ease of manufacture and inhibits development of brittleness and any accompanying tendency of soap bars made to crack during drying ater use. The invented soaps are milder than the "control" soaps, made from mixtures of coconut oil with tallow or palm kernel oil, which may be due in part to an appreciably low pH.

Also within the inventin are processes for the manufacture of the invented soap bars, which processes include partially saponifying the topped, distilled coco fatty acid, so as to produce a superfatted soap, containing free topped, distilled coco fatty acid, removing water from the partially saponified topped, distilled, coco fatty acid, mixing the superfatted soap with adjuvant(s), plodding to bar form, cutting the bar to lengths and pressing individual lengths to final bar or cake form.

3 Claims, 1 Drawing Sheet

Figure 1:
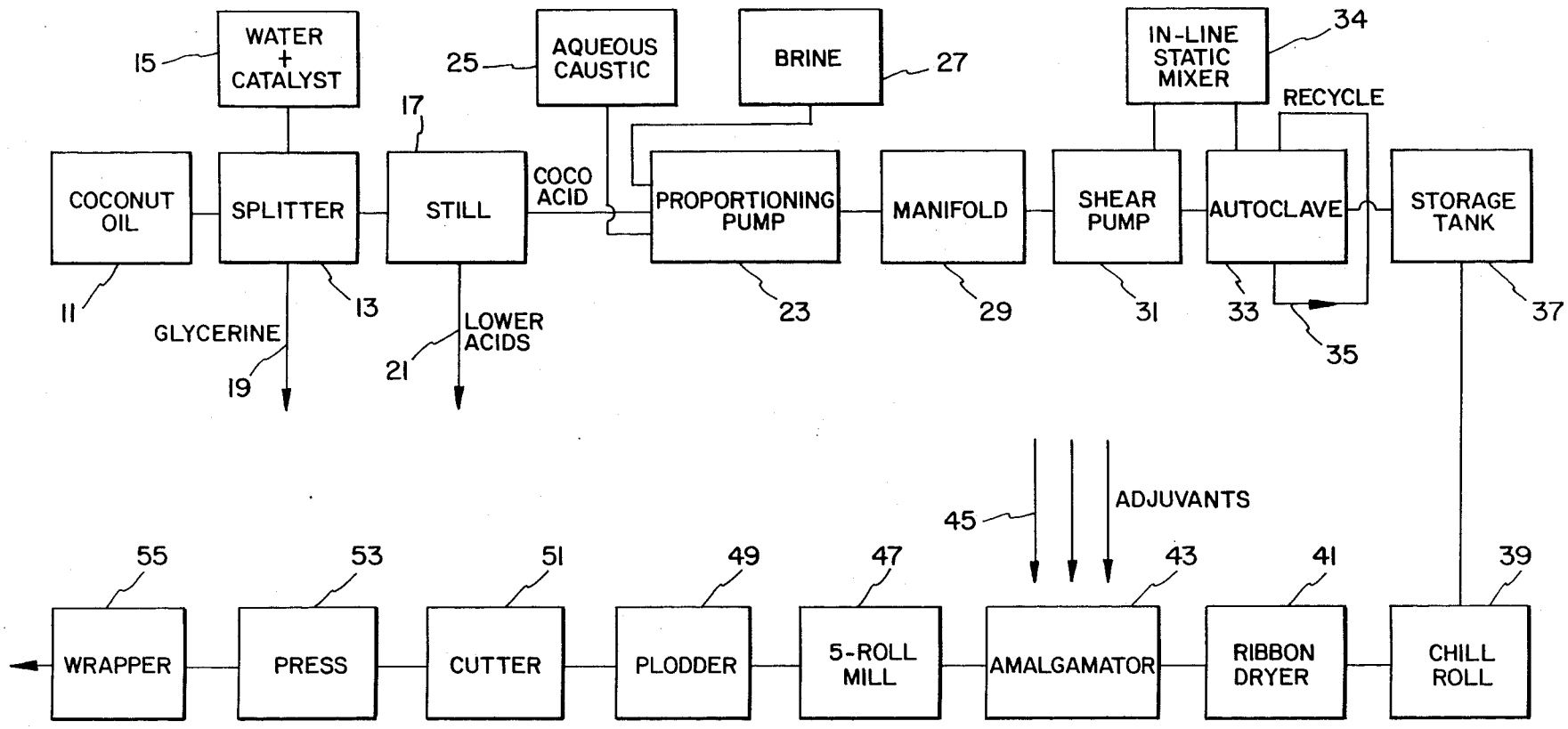

TOILET SOAP BARS MADE FROM TOPPED, DISTILLED COCO FATTY ACID AND PROCESSES FOR MANUFACTURE THEREOF

This invention relates to toilet soap bars and to a process for the manufacture of such products. More particularly, it relates to toilet soap bars in which the soap present consists of a partially saponified topped, distilled coco fatty acid. Such bars have been found to be superior to the normal tallow-coco soaps that are presently on the market, and have also been found to be superior to palm oil - palm kernel oil soaps, being significantly better than such "control" soaps in foaming properties and in lather generation, especially in cold water, and being milder to the hands.

Soaps made from mixtures of animal fats and vegetable oils have been made for many years. Today, on the American market, most of the personal or toilet soap bars or cakes are made from a mixture of tallow and coconut oil or from the fatty acids obtained from such oils. Such products have been accepted by consumers but it is recognized that the consumer will respond positively to improvements in certain properties of such soaps. In particular, foaming power, rinsing ease, lather properties and mildness are characteristics of commercial soaps that the consumer would like to see improved. Such improvements should not be obtained, in whole or in part, by merely making the soap more readily soluble in water, because that would make bars slough or erode more rapidly, which adversely affects economy of use, and also is aesthetically undesirable.

Although soaps have historically been made by saponification of fats and oils (triglycerides), with the production of byproduct glycerine, in recent years some major manufacturers of soaps and detergents have produced fatty acids and glycerine from oils and fats by hydrolysis, and subsequently have saponified or neutralized the fatty acids with caustic soda solution or other suitable alkaline material. In some instances, fatty acids made by such hydrolysis processes have been distilled and/or fractionated so as to obtain particular "cuts" thereof, corresponding to certain ranges of molecular weights, chain lengths or carbon contents, to obtain purer starting materials for chemical reactions To improve mildness, superfatted soaps have been made, which included added fats and/or oils and/or fatty acids, such as stearic acid, and in some cases, as when "cold made" soaps were produced, some of the fats and oils charged were intentionally not saponified. The manufacture of such superfatted cold made coconut oil soaps, sometimes referred to as Castile soaps, is described in the text, *Soaps and Detergents,* by Thomssen and McCutcheon (1949), at pages 145–151.

Although it was known to make superfatted soaps and to produce topped, distilled fatty acids from animal fats and vegetable oils and manufacture soaps which contained superfatted material (which was present because the manufacturing method included only partial saponification of the oil(s) charged), it is believed that prior to the present invention there had not been made soaps like those described and claimed herein, and it is believed that the particular processes herein described and claimed had not previously been practiced or published.

In accordance with the present invention a toilet soap bar of improved cold water lathering properties, improved stability on storage and improved plasticity, which is mild to the skin and which does not slough excessively when deposited wet on a soap dish, comprises sodium soap of topped, distilled coco fatty acid from which all caproic and caprylic acids have been removed, and in which the capric acid content is less than 2% of the total coco fatty acid, which coco fatty acid is the fatty acid component of the soap present, and which sodium coco fatty acid soap of topped, distilled coco fatty acid is at least 70% of the toilet soap bar, which bar contains 4 to 14% of such topped, distilled free coco fatty acid, 6 to 16% of water and no more than 8% of adjuvant(s). Also within the invention is a process for the manufacture of the described toilet soap bar which comprises partially saponifying topped, distilled coco fatty acid, from which caproic and caprylic acids have been removed, and in which the capric acid content is less than 2% of the total coco fatty acid, so that 85 to 95% of the coco fatty acid is saponified, with the balance thereof being available as free coco fatty acid, mixing the partially saponified topped, distilled coco fatty acid, containing 6 to 16% of water, on a final toilet soap bar weight basis, with no more than 8% of adjuvant(s), on the same basis, plodding the mixture to bar form, cutting the bar to lengths and pressing such lengths to final bar or cake form.

The topped, distilled coco fatty acid utilized in the present invention is one from which all caproic and caprylic acids have been removed and in which the capric acid content is less than 2% of the total coco fatty acid(s). Preferably, the topped, distilled coco fatty acid includes less than 1% of capric acid and more preferably it comprises 0.0 to 0.8% of capric acid, 50 to 60% of lauric acid, 20 to 25% of myristic acid, 8 to 12% of palmitic acid, 0.0 to 0.3% of palmitoleic acid, 1 to 4% of stearic acid, 5 to 10% of oleic acid, 0 to 3% of linoleic acid, 0 to 0.2% of linolenic acid, and 0.0 to 0.3% of arachidic acid, and is of an iodine value in the range of 8 to 12. An example of such topped, distilled coco fatty acid is one which consists of about 0.4% of capric acid, about 53% of lauric acid, about 22% of myristic acid, about 11% of palmitic acid, about 0.1% of palmitoleic acid, about 3% of stearic acid, about 8% of oleic acid, about 2% of linoleic acid, about 0% of linolenic acid, and about 0.1% of arachidic acid, and is of an iodine value of about 10. Such coco fatty acids may be made by the hydrolysis of coconut oil by any suitable process, such as the Twitchell or autoclave process for splitting triglycerides. The lower molecular weight acids, including caproic and caprylic acids, may be entirely removed, and the capric acid content may be decreased by topping the distillate, which is effected by removing the distillate from the higher plates of a rectification column or by removing the lower boiling distillate ( that which distills off earlier). The distillation process also helps to purify the fatty acid produced from the coconut oil, by removing from the desirable fatty acids any higher and lower boiling impurities which were in the coconut oil or which were produced during the hydrolysis.

The soap that is made from the topped, distilled coco fatty acid is a sodium soap, although for the manufacture of liquid soaps, potassium soaps may be made. While such a soap may be completely neutral or may consist of completely saponified fatty acids, for preferred use in the present improved toilet bars the soap is only partially neutralized and is accompanied by free topped, distilled coco fatty acid. Toilet soap bars of this invention may also be made by adding topped, distilled free coco fatty acid to a completely saponified or neutralized topped, distilled coco fatty acid soap. A preferred partially neutralized soap (and the completely neutralized soap to which free fatty acid was added) includes about 90 to 95% of the coco fatty acid thereof in saponified or neutralized form (soap) with the balance being available as free coco fatty acid. Preferably, the percentage of soap in the soap - fatty acid mixture is 91 to 94% and more preferably 92 or 93%, e.g., about 92%, on an anhydrous basis.

The toilet soap bar of this invention contains at least 70% of sodium soap of the topped, distilled coco fatty acid, 4 to 14% of such topped, distilled free coco fatty acid, 6 to 16% of water and a suitable proportion of adjuvant(s), which will normally be no more than 8% thereof. Preferably such sodium soap content of the toilet soap bar will be at least 75%, with the free coco fatty acid content of the bar being in the range of 4 to 8%, the water content being in the range of 8 to 14% and the adjuvants content being in the range of 2 to 6%. For example, the total sodium soap content may be about 80%, the content of free coco fatty acid may be about 7%, that of water may be about 12 or 13% and that of adjuvants may be about 3%. At such concentrations of the mentioned components in the toilet soap bar such bar is of improved foaming lathering characteristics and is mild to the hands. Such mildness is in part related to the bar pH, which will usually be in the range of 9 to 10, instead of above 10.5, for normal toilet soaps on the market. Other advantages of the present formulations also appear to depend on changes in the composition of the fatty acids of the sodium soaps. For example, the absence of caprylic and caproic acids and the presence of the reduced proportion of capric acid help to diminish the skin irritation potential of the product, the high percentages of lauric and myristic acid moieties in the soap contribute significantly to quickness of lather generation, and the low percentages of $C_{16}$ and $C_{18}$ acids promote faster lathering, even at lower temperatures.

In addition to the advantageous physical and chemical properties of the product, a further advantage, at least in some sections of the world, is an economic one. Thus, coconut oil and the fatty acids obtainable from it are substantially less expensive in some areas of the world, such as the Philippines, than is tallow. Furthermore, coconut oil is more readily split into fatty acids and glycerine than is tallow, making for easier and cheaper processing, and this advantage is carried over into manufacture of soap from the fatty acids. Finally, because of the narrower range of fatty acids in the coco fatty acids employed in this invention, compared to mixed tallow and coco fatty acids, the soap made is more homogeneous and therefore it is considered to be less liable to separate, crack or crumble, due to differences in compositions of the component soaps thereof.

The topped, distilled fatty acids from which the superfatted soaps of this invention are made are essentially pure but sometimes can contain a minor proportion, often only a trace, if any, of unreacted coconut oil or monoglycerides or diglycerides from such oil. Similarly, trace amounts of other organic byproducts may be present but the fatty acids are usually over 99% pure, sometimes over 99.9% pure. The higher fatty acid soaps made from the described topped, distilled fatty acids will include water, which forms part of the neat soap phase, and which results from the reaction and from the employment of aqueous alkali as a saponifying agent. A small quantity of brine may also be present in the reaction mixture (to yield 0.5 to 1% of salt in the finished soap) and brings with it a small amount of water. The neat soap produced in the saponification reaction is one which contains unreacted free coco fatty acid and it will usually contain from 25 to 35% of water. The soap may also contain a small proportion, preferably 0.5 to 1%, of sodium chloride, from the brine. There will usually be little or no free alkali in the soap, which is attributable to the excess free fatty acid and thorough reaction of all caustic present with the excess of fatty acid. After drying of the soap, as in soap chip form, the moisture content thereof will usually be in the range of 6 or 7 to 16%, preferably being about 8 to 14% and more preferably about 12%. The moisture content of the soap chip and of the resulting toilet soap bar is desirably lower than would have been necessary had the soap not been superfatted. This is advantageous in improving the resistance of the bar to excessive sloughing or gelling when the wet bar, after use, is placed in a soap dish. The moisture content in the dried soap chip and in the final bar would have to be in excess of 20% to make the amalgamator mixture processable by milling and plodding, in the absence of the superfatting free fatty acid. That much moisture would tend to promote objectionable sloughing and gelling of the bar in the soap dish. Also, the free fatty acid, being lipophilic, tends to inhibit excess absorption of water by the soap bar, thereby serving to counteract any tendency of the bar to slough or gel excessively.

In addition to water that is present with the superfatted soap, and "impurities" which are byproducts of the reaction or accompany the reactants, various adjuvants may be employed in the soap. Normally the proportion of adjuvants will be no more than 8%, preferably no more than 6%, with a preferred range being 2 to 6%, e.g., about 3 or 4%.

Among the adjuvants which may be incorporated in the present soap bars, usually by being mixed in with the superfatted soap chips in an amalgamator before milling and plodding, are: antioxidants and preservatives, such as stannic chloride; bactericides, such as trichlorocarbanilide and Irgasan ®DP-300; pigments and whitening agents, such as chrome oxide green and titanium dioxide, respectively; dyes; skin care agents, e.g., lanolin, lanolin acids and lanolin esters; and perfumes. Normally the amounts of individual components or classes of adjuvants will not exceed 2% of the bar weight, and in most cases will not exceed 1% thereof.

The processes of the present invention will be readily understood by one of skill in the art by reference to the accompanying specification, including the following description, taken in conjunction with the drawing, in which:

FIG. 1 is a block diagram which schematically illustrates the manufacturing of the invented toilet soap bars, starting with coconut oil and caustic soda reactants.

In FIG. 1, coconut oil, in storage tank 11, is transported to splitter 13, to which water and catalyst (if employed) are fed from source 15. In the splitter the coconut oil triglycerides are hydrolyzed to free fatty acids and glycerine, with the free fatty acids being conveyed to still or distillation column 17 and the glycerine exiting from the splitter through line 19. In distillation column 17 the coconut oil fatty acid is distilled under vacuum and lower acids are removed through line 21 while the topped, distilled coco acid is delivered to a proportioning pump 23. Also delivered to the proportioning pump are aqueous caustic soda and brine, from tanks 25 and 27, respectively. Prior to entering the proportioning pump the topped, distilled coco fatty acid, aqueous caustic and brine are heated. The coco acid is at least partly heated during operation of still 17, and the aqueous caustic and brine are pre-heated in tanks 25 and 27, respectively, by heating elements, not specifically illustrated. From proportioning pump 23 the coco acid, caustic and brine pass to manifold 29 and from there to shear pump 31. In the manifold and in the shear pump the coco acid is saponified, and due to an intentional deficiency of caustic, the reaction is not carried to completion, although all the caustic is consumed in autoclave 33, or other suitable recycling reactor, to which the reaction mix is pumped by the shear pump 31 through in-line static mixer 34. As illustrated, the resulting superfatted soap and any other materials present are continuously recycled through line 35. A portion of the material, sufficient to match that being charged to the autoclave, is withdrawn from it and sent to storage tank 37. Next soap, containing about 30% of water, and being at an elevated temperature (often about 85° C.), is delivered to a Mazzoni vacuum dryer, or to a chill roll 39, on which it is converted to conventional ribbon form and is sent to ribbon dryer 41 or other suitable dryer, wherein it is dried to a moisture content which is normally between 6 and 16%. The dried soap, preferably in chip form, is added to an amalgamator 43, together with suitable adjuvants, the additions of which are represented by arrows 45. The amalgamator mix is passed to a refiner-mixer or to a 5-roll mill 47, from which it progresses to plodder 49, cutter 51, press 53 and wrapping machine 55.

Various steps in the processing of the described coconut oil and of the soap of topped, distilled coco fatty acids are conventional, including the hydrolysis of the coconut oil and the soap processing procedure from the chill roll through the wrapping stage. However, some aspects of the overall process are considered to be novel and especially desirable, yielding unexpectedly beneficial effects, and hence such aspects are considered to be unobvious. In one such aspect of the invention the coco fatty acids made are topped in a distillation process which results in such acid containing no caproic and caprylic acids and containing less than 2%, and preferably less than 1%, of capric acid. Such material is saponified with aqueous caustic in the presence of brine, using a proportioning pump, preferably of the Bran & Lubbe type, from which the pre-heated coco acid, caustic and brine are pumped to a manifold, and then to a shear pump, preferably of the Waukesha type, wherein they react, after which the mix is pumped to a static in-line mixer, and then to an autoclave or similar recycling reactor, wherein the recycling ratio is in the range of 20:1 to 30:1, preferably 25:1 to 30:1. The preferred autoclave employed is of the Mazzoni type, but other equivalent recycling reactors may be substituted, provided that the results are satisfactory. From the autoclave the neat soap mix is pumped to a storage tank, and subsequently it is removed from the tank, dried and amalgamated with adjuvants to give the product particular desirable characteristics (water may be added in the amalgamator to adjust the moisture content of the final bar, too) and in cases where a deficiency of caustic is not employed, to produce a superfatted soap, (topped, distilled, coco fatty acid may be added in the crutcher or in the amalgamator to produce a superfatted soap). The soap made is then milled, plodded, cut to bar lengths, pressed and wrapped, after which it is cased, warehoused, and transported to stores where it is to be sold.

In a broad aspect of the invention, in the saponification stage wherein the topped, distilled coco fatty acid is treated with aqueous caustic and brine, about 85% to 94% of the coco fatty acid is saponified, with the balance thereof being available as free coco fatty acid. The mixture of soap and free fatty acid, which contains about 6 to 16% of water, on a final toilet soap bar weight basis, also includes no more than 8% of adjuvant(s). The adjuvants are added in a soap amalgamator, after which the amalgamator mix is plodded to bar form, cut to lengths, and pressed to final bar or cake form. In a preferred version of this process the partial saponification of the coco fatty acid is to an extent so that 88 to 93% of it is saponified, and the soap resulting, with free coco fatty acid accompanying it, which contains 8 to 14% of water, on a final toilet soap weight basis, is mixed with no more than 6% of adjuvants, after which the mix is milled, plodded, cut to lengths and pressed to final bar or cake form. In such processes and in those described in conjunction with the drawing, the neat soap (which preferably contains free fatty acids) may be dried to a moisture content in the range of 6 to 16%, which range may be increased, in some instances, to as much as 20%, allowing for some losses of moisture during possible storage of the soap chips before further processing, and during processing (especially milling). However, a more preferred moisture content of the final bar is in the range of 7 to 13 or 14%.

In a preferred process the preferred topped, distilled coco fatty acid, containing 0.0% of caproic acid, 0.0% of caprylic acid, and 0.0 to 0.8% of capric acid, which is of an iodine value in the range of 8 to 12, is reacted with a caustic soda solution which contains 40 to 50% of caustic soda in water, in the presence of a brine solution which is an aqueous solution of 15 to 20% sodium chloride content, the coco fatty acid, caustic soda solution and brine solution are pre-heated individually to temperatures in the range of 40° to 100° C., they are fed by a Bran & Lubbe type proportioning pump into a common header, which is immediately prior to the inlet to the Waukesha type shear pump, from which the mix passes to an in-line static mixer, and then to a Mazzoni type autoclave, in which the recycle ratio is in the range of 20:1 to 30:1. From the autoclave the soap mixture is sent to a storage tank, or a dryer. From here on the various manufacturing steps are conventional for toilet soap processing. However, when insufficient free coco acid is present in the soap additional such material may be added in the crutcher or amalgamator to bring the soap made to a satisfactory level of free fatty acid content and to lower the pH so as to improve the mildness of the product.

The following examples are given to illustrate the invention but are not considered to be limiting. Unless otherwise stated, all parts and percentages in such examples, the specification and the claims are by weight and all temperatures are in °C.

EXAMPLE 1

A topped, distilled, coco fatty acid which consists of 0.0% of caproic acid, 0.0% of caprylic acid, 0.4% of capric acid, 53% of lauric acid, 22% of myristic acid, 11% of palmitic acid, 0.1% of palmitoleic acid, 3% of stearic acid, 8% of oleic acid, 2% of linoleic acid, 0% of linolenic acid, and 0.1% of arachadic acid, and which is of an iodine value of 10, is reacted with a lesser molar proportion of 49% NaOH content aqueous caustic soda solution in the presence of a small volume of an 18% NaCl content aqueous sodium chloride solution (to make a soap containing 0.7% of NaCl) at a temperature in the range of 100° to 120° C. in a Waukesha shear pump, to produce a soap containing about 7% of free fatty acid. The coco acid and caustic solution are proportioned by a proportioning pump of the Bran & Lubbe type, which discharges the proportioned feeds into a common header immediate prior to the inlet to the shear pump. From the shear pump the mix is passed to an in-line static mixer and from there to a Mazzoni autoclave in which the recycle ratio is about 28:1, and the continuous process is operated in such manner that as much soap product is removed as fatty acid, caustic solution and brine are added. The discharge from the autoclave, which is at a temperature of about 120° C., is sent to a holding tank and from there is pumped to a dryer. The soap produced is of a free fatty acid content of about 7% and of a moisture content of about 13%. The dried soap is then further processed, using the equipment illustrated in FIG. 1, with 0.5% of titanium dioxide and 1.5% of perfume being added to it in the amalgamator. The product resulting is of a pH (1% solution in water) of 9.3 and is mild to the hands and human skin. The soap bar does not slough or gel excessively in the soap dish, and in consumer evaluations the bars are found to be significantly better than commercial toilet soap bars in lather characteristics and in quickness of foaming, especially when used to wash the hands in cold water of about medium hardness (100 p.p.m., as $CaCO_3$). Another very significant advantage of the invented bars is in their ease of rinsing off, which is considered to be exceptionally good. Overall, the bars of this example are significantly preferred over high quality, commercially successful complexion soaps.

In modifications of this experiment, when proportions are varied within the ranges previously recited herein, and when different adjuvants are employed of the types that have been described, the results that are obtained are essentially the same.

EXAMPLE 2

(Comparative)

The experiment of Example 1 is repeated but with a stoichiometric proportion of sodium hydroxide solution being employed so that the bars to be made contain no free fatty acid. Otherwise the conditions of the experiment are the same and the final product is intended to contain 13% of water. Processing of this soap is very difficult, with satisfactory milling and plodding being unobtainable unless more water or suitable plasticizer is added. To make the composition processable on bar making machinery there has to be added to the amalagamator sufficient additional water to raise the final bar moisture content to 22%. At this high level of moisture a satisfactory chip forms on the mill and a cohesive plodder bar is produced. However, the pressed bars made tend to be unduly soft and subject to excessive sloughing, when wet. Also, they are at a pH in excess of 10 and therefore are not as mild to the skin or as safe to use on tender skins as are the experimental bars of Example 1. Another significant difference in the comparative and experimental bars is that the comparative bars do not rinse as easily from the skin.

EXAMPLE 3

When proportions of the components of the soap bars of Example 1 are changed, ±10% and ±20%, while still being maintained in the ranges mentioned in the preceding specification, and when minor changes are made in the components, as by removing all capric acid from the topped, distilled coco fatty acid, adding 1% of lanolin esters and adding 0.3% of germicide, e.g., trichlorocarbanilide, the product resulting is an acceptable, mild germicidal complexion soap. Such product is acceptable to the consumer and is also acceptable when the moisture content thereof is varied over the range of 8 to 14%. At moisture contents as low as 6% one will desirably incorporate more free topped, distilled coco acid and/or lanolin esters. In another variation of this example the unsaturates of the coconut oil may be hydrogenated to saturation before splitting, distilling and topping. In such case, more stearic acid soap will be present in the final product and to compensate for the removal of the unsaturates (which removal may be desirable because it makes the soap more stable) one may employ more of the free coco acid or other plasticizer in the final formula.

Further modifications of the examples given above may be made wherein conditions, components and proportions are varied within the ranges previously recited in this specification, and the products that will be obtained are within the scope of the invention.

This invention has been described in conjunction with illustrations and examples thereof but is not to be limited to such embodiments because it is evident that one of skill in the art, with the present specification and drawing before him or her, will be able to utilize substitutes and equivalents without departing from the invention.

What is claimed is:

1. A process for manufacturing a toilet soap bar of improved cold water lathering properites, improved stability on storage and improved plasticity, which is mild to the skin and which does not slough excessively when deposited wet on a soap dish, which bar comprises at least 70% of sodium soap of topped, distilled coco fatty acid from which all caproic and caprylic acids have been removed, and in which fatty acid the capric content is less than 2%, 4 to 14% of such topped, distilled free coco fatty acid, 6 to 16% of water and no more than 8% of adjuvant(s), which manufacturing process comprises pre-heating the topped, distilled coco fatty acid, caustic soda solution and brine solution, separately feeding the heated topped, distilled coco fatty acid, caustic soda solution and brine solution to a proportioning pump, discharging them from said proportioning pump to a shear pump in which they are initially intimately mixed and the coco fatty acid and caustic soda are reacted, heating the mixture in an autoclave, recycling a high proportion of the reaction mixture back to such autoclave, while feeding to such autoclave a low proportion of previously unrecycled material discharged from the shear pump, removing the resulting superfatted soap from the autoclave, drying it to a moisture content in the range of 6 to 16%, mixing it with no more than 8% of adjuvant(s), plodding such mixture to bar form, cutting the bar to lengths and pressing such lengths to final bar or cake form.

2. A process according to claim 1 wherein the topped, distilled coco fatty acid comprises 0.0% of caproic acid, 0.0% of caprylic acid, 0.0 to 0.8% of capric acid, 50 to 60% of lauric acid, 20 to 25% of myristic acid, 8 to 12% of palmitic acid, 0.0 to 0.3% of palmitoleic acid, 1 to 4% of stearic acid, 5 to 10% of oleic acid, 0 to 3% of linoleic acid, 0 to 0.2% of linolenic acid, and 0.0 to 0.3% of arachidic acid, and is of an iodine value in the range of 8 to 12, the caustic soda solution is an aqueous solution of 40 to 50% caustic soda content, the brine solution is an aqueous solution of 15 to 20% sodium chloride content, the topped, distilled coco fatty acid, the caustic soda solution and the brine solution are pre-heated individually to temperature(s) in the range of 40° to 80° C., the proportioning pump to which they are fed is of the Bran & Lubbe type, the discharges from the proportioning pump are into a common header immediately prior to the inlet to the shear pump, the shear pump is of the Waukesha type, the autoclave is of the Mazzoni type, and the autoclave recycle feed ratio is in the range of 20:1 to 30:1.

3. A process for manufacturing a toilet soap bar of improved cold water lathering properties, improved stability on storage and improved plasticity, which is mild to the skin and which does not slough excessively when deposited wet on a soap dish, which bar consists essentially of at least 70% of sodium soap of topped, distilled coco fatty acid, 4 to 14% of such topped, distilled free coco fatty acid, 6 to 16% of water and no more than 8% of adjuvant(s), which comprises preheating an aqueous solution of sodium hydroxide, brine and topped, distilled coco fatty acid, separately feeding the pre-heated sodium hydroxide solution, brine and coco fatty acid to a proportioning pump, feeding the discharge from the pump to a manifold and thence to a shear pump, in which the sodium hydroxide and coco fatty acid are intimately mixed and reacted in the presence of the brine, after which the reaction mixture resulting is passed through an in-line static mixer to an autoclave for further reaction, and a high proportion of the saponification mixture resulting is recycled to the autoclave to saponify 85 to 94% of the coco fatty acid, with the balance of the coco fatty acid being available as free coco fatty acid, drying the sodium coco soap—free coco fatty acid mixture to a moisture content in the range of 6 to 16%, mixing such drived soap—fatty acid mixture with no more than 8% of adjuvant(s) and plodding such mixture to bar form.

* * * * *